United States Patent [19]

Briggs

[11] Patent Number: 4,838,464

[45] Date of Patent: Jun. 13, 1989

[54] VENTED PLASTIC BOTTLE

[75] Inventor: Milton Briggs, Dallastown, Pa.

[73] Assignee: Graham Engineering Corporation, York, Pa.

[21] Appl. No.: 246,871

[22] Filed: Sep. 20, 1988

Related U.S. Application Data

[63] Continuation-in-part of Ser. No. 61,538, Jun. 11, 1987, abandoned.

[51] Int. Cl.[4] ..... B67D 3/00

[52] U.S. Cl. ..... 222/478; 215/1 C; 215/31; 222/481

[58] Field of Search ..... 222/468, 478, 479, 481, 222/481.5, 482, 488, 489; 215/1 C, 31

[56] References Cited

U.S. PATENT DOCUMENTS

| | | | |
|---|---|---|---|
| D. 264,308 | 5/1982 | Campbell . | |
| D. 268,810 | 5/1983 | Hartung . | |
| D. 282,349 | 1/1986 | Larson et al. | D9/395 |
| 763,973 | 7/1904 | Flynn et al. . | |
| 1,509,360 | 9/1924 | Lewis | 222/478 |
| 3,066,819 | 12/1962 | Cox . | |
| 3,198,367 | 8/1965 | Stickney | 215/1 C |
| 3,232,495 | 2/1966 | Schneider | 222/468 |
| 3,251,514 | 5/1966 | Speicher | 222/468 |
| 3,398,427 | 8/1968 | John . | |
| 3,743,467 | 7/1973 | Lopez . | |
| 3,746,200 | 7/1973 | Flider | 222/479 X |
| 3,807,713 | 4/1974 | Cornett, III et al. . | |
| 4,100,235 | 7/1978 | Thornwald . | |
| 4,217,328 | 8/1980 | Cambio, Jr. . | |
| 4,412,633 | 11/1983 | Guerrazzi et al. | 222/468 |

FOREIGN PATENT DOCUMENTS

| | | | |
|---|---|---|---|
| WO8701677 | 3/1987 | PCT Int'l Appl. . | |
| 215112 | 6/1941 | Switzerland | 215/31 |
| 2098572 | 11/1982 | United Kingdom . | |

OTHER PUBLICATIONS

Packaging News; Dec. 1986, vol. 31 No. 13 p. 15. Kleenpour International Flyer.

*Primary Examiner*—Kevin P. Shaver
*Attorney, Agent, or Firm*—Thomas Hooker

[57] ABSTRACT

A hand held blow molded plastic bottle having a vent passage extending along the interior of the bottle shoulder from the top of the body to the bottom of the neck. During pouring, air flows through the vent passage to a vacuum produced pocket in the bottle and liquid flows from the bottle in a continuous, controllable and rapidly laminar stream.

11 Claims, 4 Drawing Sheets

VENTED PLASTIC BOTTLE

This is a continuation-in-part of co-pending application Ser. No. 061,538, filed June 11, 1987, now abandoned.

BACKGROUND OF THE INVENTION

The invention relates to blow molded plastic bottles with improved pour capabilities and, more particularly, to bottles of this type that are easily grasped in one hand during manipulation and pouring.

BRIEF DESCRIPTION OF THE PRIOR ART

Conventional blow molded hand grasped bottles are filled with liquids of various viscosities. These liquids include lubricants, transmission fluids, solvents, hazardous chemicals, food, detergents and the like. The bottles have a capacity of up to approximately two liters. The bottles commonly have a base, a body, an inwardly sloping shoulder, a neck and a neck finish compatible with the closure to be used. In some bottles the body extends smoothly up to the neck without a shoulder. A closure on the neck finish seals the bottle. The neck finish may be located at the center or to one side of the bottle.

In order to be used, the contents must be poured from the bottle, typically in a gravitational flow. Liquid poured from a conventional hand grasped bottle flows out from the mouth of the bottle in intermittent spurts or "glugs" as air is siphoned in through the same mouth to an air pocket within the bottle. The "glug" pouring problem is worse with narrow neck bottles than with wide neck bottles. Liquid poured from the conventional bottle is relatively uncontrollable, particularly while the bottle is being inverted to allow the contents to drain downwardly through the mouth and into a filling opening. Draining from the inverted bottle is slow. The intermittent or "glug" discharge during pouring is erratic and leads to waste and splashes that could be dangerous when pouring flammable or chemically aggressive liquids, for instance when an attempt is made to pour the contents from a partially inverted bottle quickly into a relatively small opening. The flow cannot be aimed accurately and the discharge cannot be easily controlled.

SUMMARY OF THE INVENTION

The one example of the improved blow molded bottle is provided with an interior vent passage extending along the bottle from the neck finish to about the bottom of the shoulder. This vent passage may extend an additional distance down the body toward the base of the bottle. During pouring, air flows through the vent passage into the interior of the bottle to equalize air pressure on the interior and exterior of the bottle. As a result, liquid pours from the mouth rapidly in a continuous laminar flow stream. This flow is easily aimed. The bottle is rapidly emptied.

Extrusion blow molding requires that a parison be captured between two mold halves before it is blown into a bottle of desired shape. The integral vent passage is formed by capturing a small circumferential portion of the parison along the length of the passage and creating a pinch that joins the sides of the portion and separates the vent passage from the main chamber of the bottle. This portion of the parison is difficult to control in the mold because of variations that occur normally during the blow molding process. The variations can result in improper capture of the parison and closing of the vent passage at its lower mouth. The variations can close the lower mouth to seal the vent passage and prevent vented pouring. These variations include variations in the temperature of the parison, variations in programming, or even variations in parison position between the two mold halves. Closure of the lower mouth is prevented by laterally flaring the lower end of the passage.

Liquid poured from a partially inverted blow molded bottle according to the invention is discharged in a steady, continuous controlled and rapid stream easily aimed at a desired target area. The discharge is considerably faster than the intermittent or "glug" discharge from a bottle of the same geometry but without the vent passage. Liquid pours from an inverted improved bottle at a rate faster than the same liquid pours from an inverted conventional bottle of the same geometry but without the vent passage. The more viscous the product, the greater the improvement.

The vent passage is an integral part of the neck and bottle shoulder and requires no appreciable extra plastic over the amount required for the manufacture of the same bottle without the vent passage. The passage strengthens the top load resistance of the bottle.

The vent passage may be used in bottles of a given shape. This feature enables vent passages to be incorporated in proprietary shaped bottles without loss of trade recognition or goodwill in the particular bottle. Manufacturers can improve the pour capabilities of their bottles without sacrificing bottle recognition or integrity. Vent passage bottles can be grouped together, packaged and displayed like conventional bottles without this feature. Also smaller mouths can be used.

In the example of the blow molded bottle having a generally cylindrical body the neck and neck finish are coaxial with the body even though the vent passage, which requires a greater amount of plastic than the remainder of the neck, is located asymmetrically to one side of the bottle. Axial alignment of the neck and neck finish with the body of the bottle, without cocking of the neck and finish, is required for aesthetic and marketing reasons. The desired alignment is achieved by extending the angled recesses formed in the top of the body to either side of the vent passage up along the neck and through the step at the junction between the neck and the neck finish. This structure reduces the amount of plastic required at the neck and prevents localized shrinkage of the neck plastic across from the vent passage and resultant cocking or tilting of the neck and finish.

Other objects and features of the invention will become apparent as the description proceeds, especially when taken in conjunction with the accompanying drawings illustrating the invention, of which there are four sheets and two examples.

IN THE DRAWINGS

FIG. 1 is a side view of a first example bottle according to the invention;

FIGS. 2 and 3 are views taken along lines 2—2 and 3—3 respectively of FIG. 1;

Figure 1:
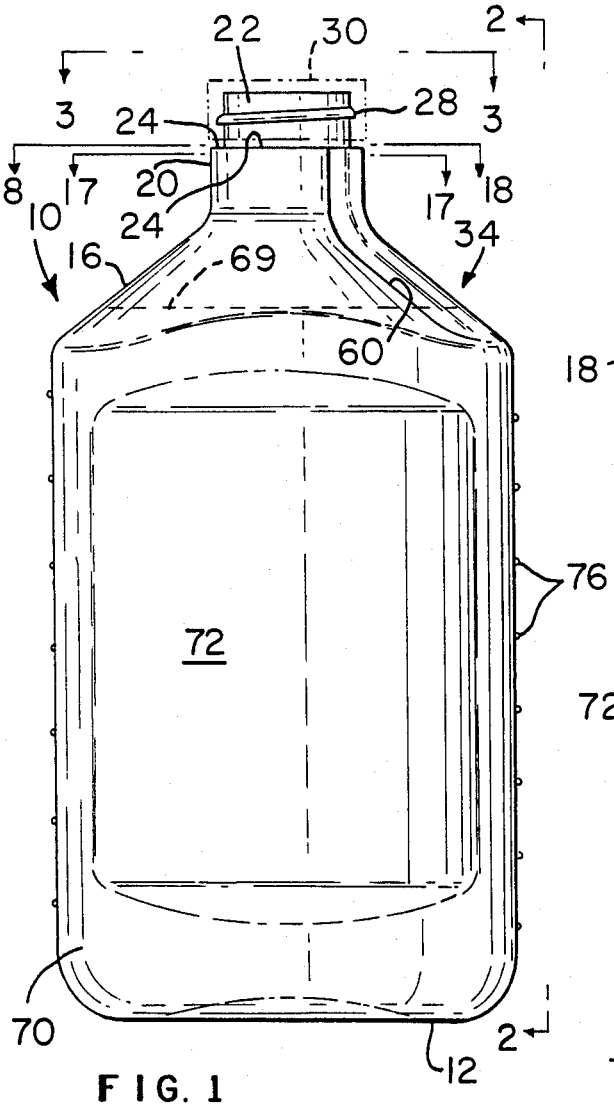
Figure 17:
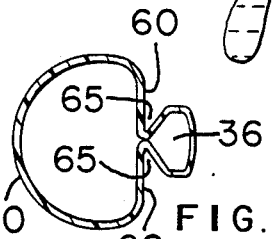
Figure 18:
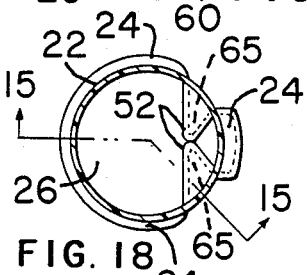
Figure 19:
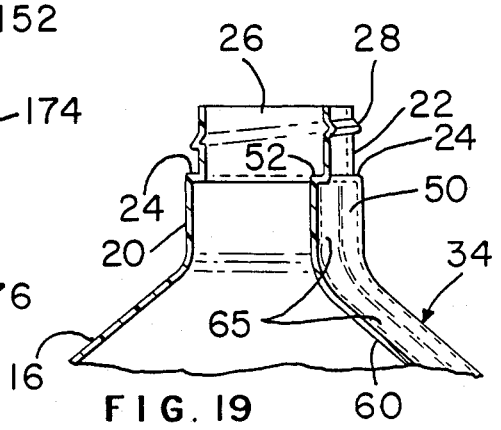

FIGS. 17 and 18 are taken along line 17—17 and 18—18 of FIG. 1, respectively; and FIG. 19 is taken along line 19—19 of FIG. 18.

DETAILED DESCRIPTION OF THE PREFERRED EXAMPLES OF THE INVENTION

FIGS. 1 through 10 illustrate a generally cylindrical first example blow molded body held bottle 10 according to the invention. The bottle includes a closed base 12 and a generally vertical body 14. The top of the bottle includes an inwardly sloping generally conical shoulder 16 joining the top of the body at edge 18, a cylindrical neck 20 at the top of the shoulder 16 and a smaller cylindrical neck finish 22 joining the top of the neck at radial inward partial circumferential step 24. Mouth 26 opens into the interior of the bottle. A thread 28 is molded into the exterior of the neck finish to facilitate mounting cap 30 (illustrated in dotted lines only) on the finish to close the mouth and seal the bottle. The cap 30 has an outer cylindrical surface essentially continuous with the surface of neck 20. The cap forms a seal against lip 32 at the top of the finish. Other types of neck finishes and closures may be used to seal the bottle.

Interior vent tube 34 extends along one side of the top of the bottle from edge 18 upwardly to the step 24. During pouring, the bottle is tilted from the vertical position of FIGS. 1 and 2 with the vent passage positioned on the top of the bottle. The vent passage extends along the side of the bottle continuously from upper mouth 38 at step 24 through a vertical straight portion 40 along the neck, around an obtuse angle bend 42 and then radially outwardly and downwardly along an angled straight portion extending radially outwardly and downwardly along the interior of the shoulder 16 to an enlarged inward facing lower mouth 46 adjacent edge 18. See FIGS. 2 and 4.

Figure 7:
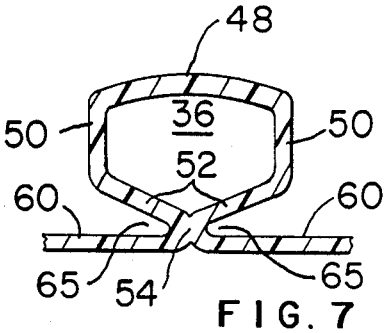
FIG. 7 is an enlarged sectional view taken along line 7—7 of FIG. 4.
Figure 6:
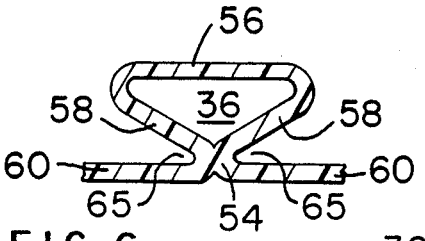
FIG. 6 is an enlarged portion of FIG. 5.

The vertical portion 40 of the tube has a general cross section shown in FIG. 7 with an outer wall 48 forming part of the outer surface of neck 20, a pair of side walls 50 extending inwardly from wall 48 and a pair of angled interior walls 52 joining at a weld seam or pinch line 54 extending along the length of the vent passage. The cross section of vent passage 34 along the straight portion 44 is shown in FIG. 6. Along this portion the vent passage includes an outer wall 56 forming part of the surface of shoulder 16 and a pair of angled interior walls 58 joining at seam 54.

Figure 3:
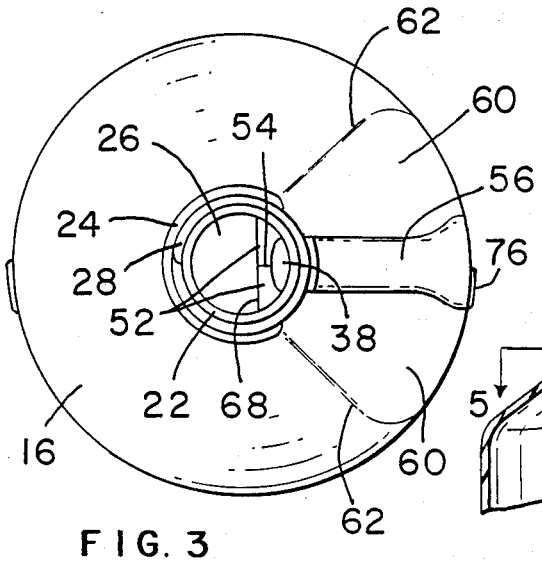
Figure 4:
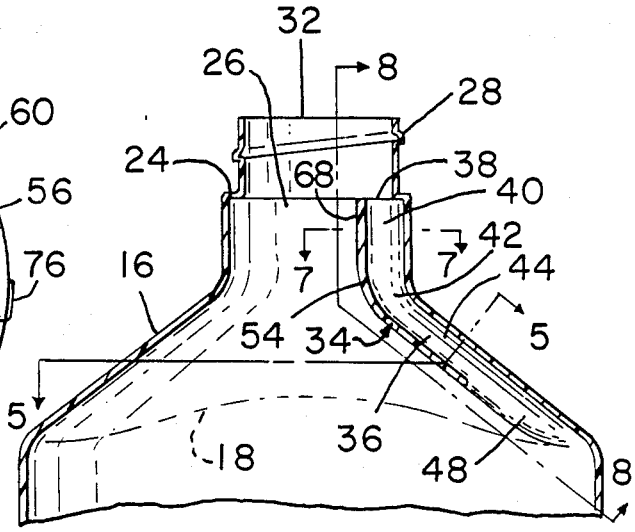
FIG. 4 is a sectional view taken along line 4—4 of FIG. 2.
Figure 5:
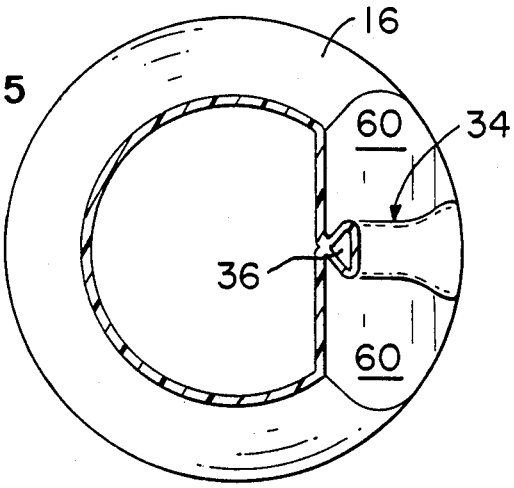
FIG. 5 is a sectional view taken along line 5—5 of FIG. 4.

The shoulder and neck include wall sections 60 located to either side of the vent passage and joining the vent passage at the weld seam 54. Wall sections 60 slope upwardly from edge 18 along the shoulder and then vertically along the neck 20. The sections are generally flat at the shoulder and neck. As shown in FIG. 3, they intersect with the conical shoulder surface at generally straight edges 62. Likewise, the sections intersect the cylindrical neck at straight edges 63. The wall sections 60 extend from edges 62 and 63 to the seam 54 at angled or vee-shaped recesses 65. Each section 60 occupies approximately 45 degrees around the top of the bottle to either side of the weld seam 54 so that edges 62 and 63 are approximately 45 degrees to either side of the seam 54 and 90 degrees apart.

Figure 8:
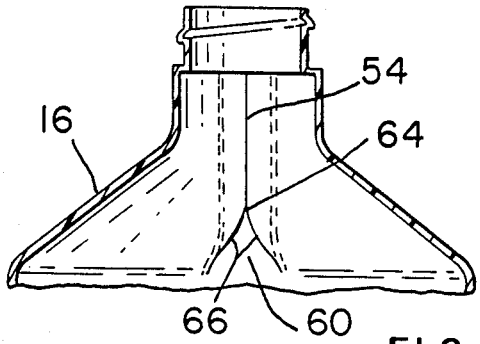
FIG. 8 is a sectional view along line 8—8 of FIG. 4.

At the lower mouth 46 the interior passage walls 58 extend down past the end of the weld seam 54 and the walls are flared outwardly to open the passage and provide a wide and high month larger than the passage 36. The seam ends at mouth apex 64 located above the ends of the interior walls. Mouth edges 66 on walls 58 diverge laterally from the apex to a maximum width larger than the width of the passage 36. The divergent edges 66 and bottom of the mouth on edge 18 define generally triangular shaped mouth 46. As shown in FIG. 8, the mouth may be generally equilateral in shape.

Figure 10:
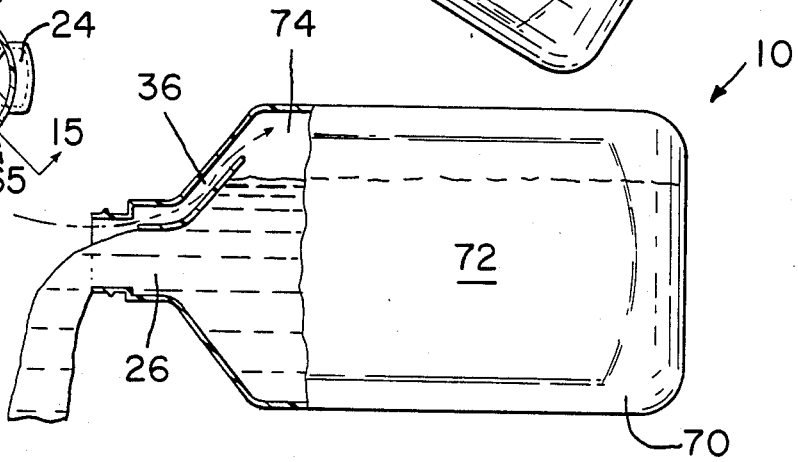

The vent passage and tube side walls 50 increase the depth of the vent passage at vertical portion 40 so that mouth 38 located inside step 24 has sufficient area to flow air through the vent passage 36 during pouring without restriction. As shown in FIG. 3, the walls 50 and passage interior wall 52 join at mouth 38 to form a dam 68 extending straight across the top of the neck 20 at step 24. The dam channels the flow of liquid from the bottle as shown in FIG. 10 to prevent the flow of liquid poured from the bottle from closing mouth 38.

In order for liquid to be poured out of the bottle in a laminar, easy to direct flow, it is necessary that during pouring two things happen simultaneously. The liquid must pour out through the neck of the bottle, and air must flow continuously back into the bottle in a counterflow to that of the liquid and through the same neck opening, to maintain equal pressure inside and outside the bottle.

To achieve this, the dam 68 separates the flow of liquid pouring out of the bottle away from the upper passage mouth in the neck to permit to flow back into the bottle through the same neck and then the vent passage.

The vent passage has a sufficiently large cross-sectional area to allow liquid, particularly relatively viscous motor oil, trapped in the passage at the beginning of pouring to be blown out of the vent passage and back into the bottle by pressure of the air starting to flow through the vent passage when the liquid is first poured out of the bottle and a slight vacuum is created inside the bottle. Liquid does not cling in the passage due to capillary action.

Figure 2:
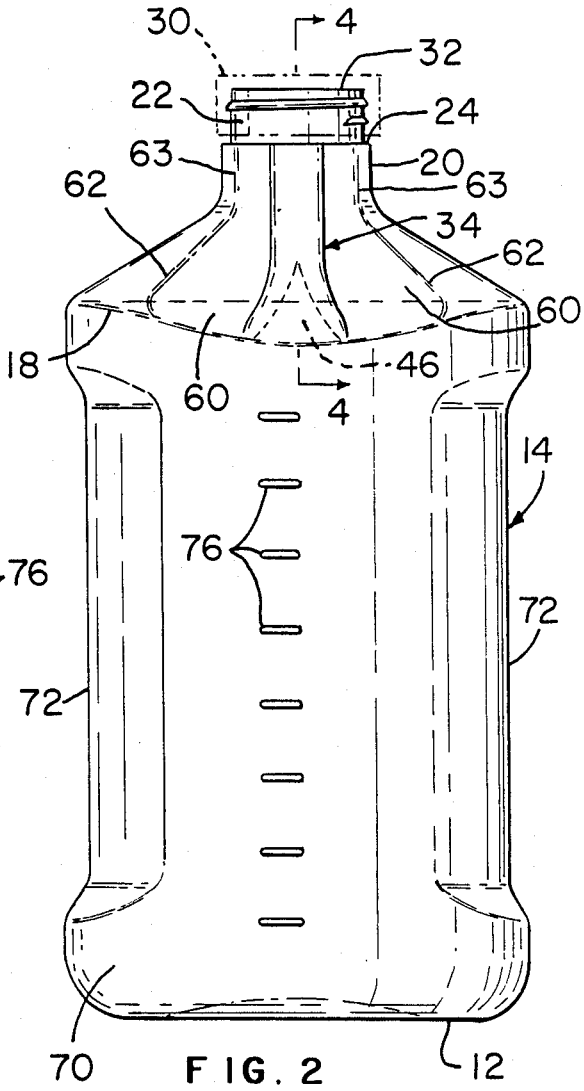

The vertical bottle body 14 includes a generally cylindrical wall 70 with a pair of grip recess walls 72 located on the sides of the bottle away from the vent passage as shown in FIGS. 1 and 2. The recess walls 72 extend along nearly the entire height of the body and have a circumferential width nearly equal to the diameter of the body to permit a person using the bottle to hold the bottle in one hand by gripping the recess walls.

Figure 9:
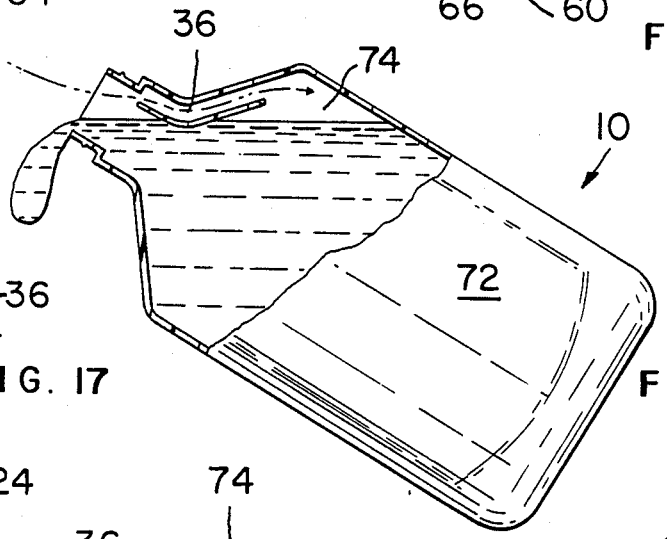
FIGS. 9 and 10 are partially broken away side views of a first example bottle illustrating pouring a liquid from the bottle.

Liquid is poured from a filled bottle 10 by gripping the bottle, removing the cap and then tipping the bottle as shown in FIG. 9 with the vent passage 36 positioned on top of the bottle. As the bottle is tipped the liquid level, because of the friction free nature of liquids and gravity, remains horizontal and contacts wall sections 60 as pouring commences. During pouring the vent passage 36 permits communication between the exterior of the bottle and air pocket 74 in the bottle to flow air into the pocket. Liquid freely flows out of the bottle in a continuous, steady and easily aimed laminar flow stream shown in FIG. 12. The mouths 38 and 46 and vent passage 36 are sufficiently large in cross sectional area to flow air into the pocket 74 without restricting the flow of liquid out the mouth. The lower mouth is preferably above the level of liquid in the filled, vertical bottle.

Liquid poured from bottles without a vent passage is discharged in intermittent and randomly flowing "glugs" and causing small spasmodic drops. The discharge is interrupted by the need to flow air into the interior of the bottle through the same opening used to flow liquid out of the bottle. With this discharge it is impossible for liquid to be poured rapidly into a target opening without spilling. For example, liquid cannot be quickly and accurately poured from a conventional body held blow mold bottle into a small targeted opening. The vent passage of the present invention eliminates this problem and permits easy, rapid, continuous, controlled and aimable pouring. The continuous smooth flow may be directed into the desired opening without spills or splatters.

The vent passage also facilitates pouring the liquid from an inverted position, that is when a filled bottle as shown in FIGS. 1 and 2 is turned around 180 degrees so that the mouth 26 is at the bottom of the bottle. Liquid is discharged in a single rapid downward stream as the interior of the bottle is vented through the vent passage. Tests of this type of pouring were conducted by filling a one quart bottle of the type shown in FIGS. 1 and 2 with a quart 10W-40 grade of motor oil at 65° F. and then rapidly inverting the bottle 180 degrees so the oil poured down vertically from the bottle. The time required to empty the bottle was measured. The tests were repeated 100 times per bottle.

The oil drained from a bottle with a vent passage in an average time of 6.48 seconds with a standard deviation of 0.17 seconds. The oil drained from a conventional bottle having the same shape as the FIG. 1 bottle but without a vent passage in an average time of 20.70 seconds with a standard deviation of 1.61 seconds. The oil drained from the vented bottle was approximately 300% faster than the oil from the bottle without the vent passage.

Liquid marketed in held bottles of the type disclosed is frequently discharged directly into an open port by quickly inverting the bottle and then placing the neck finish in the opening. Use of the vent passage bottle permits pouring oil into an automobile in this manner in about ⅓ the time required to drain oil from a like bottle without the vent passage.

The vent passage 34 in blow-molded cylindrical bottle 10 is located on one side of the bottle. See FIG. 1. This bottle is blow molded from a relatively small diameter parison which must contain sufficient plastic resin to meet the requirements of the passage without adversely affecting the remainder of the bottle.

In bottle 10, the vee-shaped recesses 65 extend upwardly through the step 24 and to the bottom of the neck finish 22, as shown in FIGS. 18 and 19, thereby reducing the amount of neck plastic which would be otherwise required if a circumferentially continuous step were provided. This break in the step enables blow molding of a desired generally cylindrical bottle from a parison without the necessity of increasing the thickness of the parison at the neck portion. An increase in the thickness at the neck portion is required to blow mold this type of bottle with the vent passage and a continuous step. Such an increased thickness at the parison at the neck has the disadvantage of providing an increased volume of resin to the neck across from the vent passage. Upon cooling the increased volume of plastic shrinks to cock or tilt the neck and neck finish in a direction away from the bottle axis. This cocking or tilting is unacceptable for aesthetic and marketing reasons and is avoided by extending the recesses 65 past the step.

Figure 12:
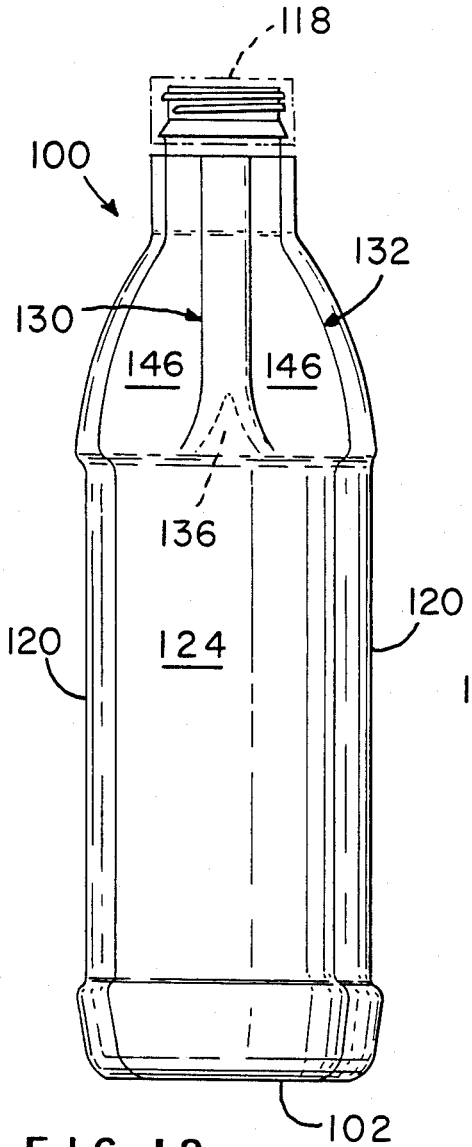
FIGS. 11, 12 and 13 are two side views and a top view of a second example bottle.
Figure 11:
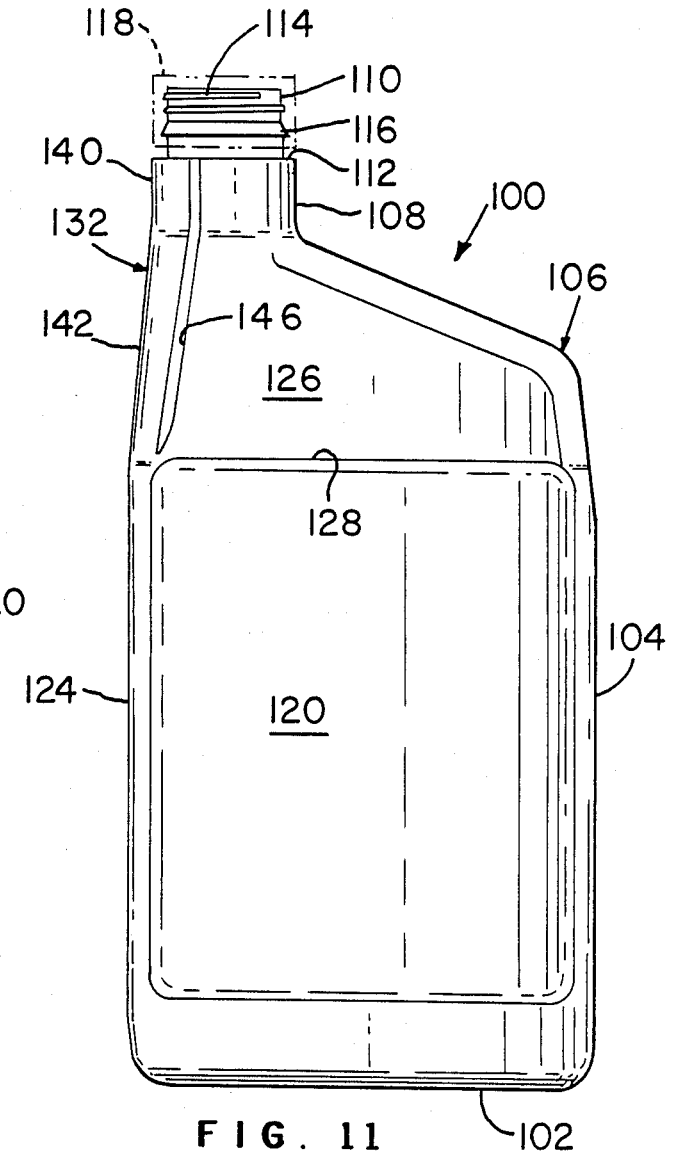
Figure 13:
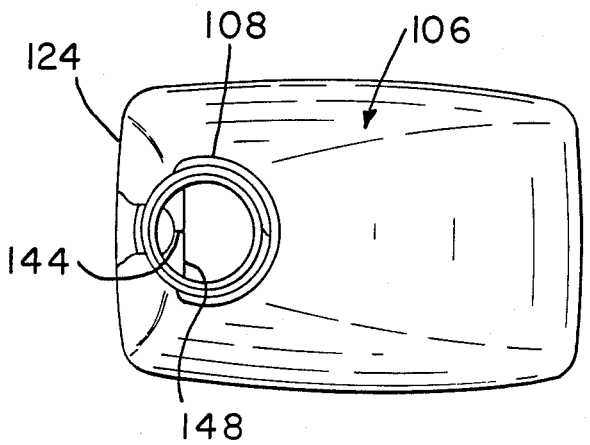

FIGS. 11, 12 and 13 illustrate a generally rectangular second example blow molded body held bottle 100 having an interior vent passage like the vent passage of bottle 10. Bottle 100 is blow molded and has a base 102, generally vertical body 104, and a top including shoulder 106, cylindrical neck 108, and cylindrical neck finish 110 projecting above the neck. The neck is joined to the neck finish by a radially inward step 112 similar to step 24. Neck finish 110 carries a cap thread 114 and a circular snap rib 116 located between the thread and step 112. Cap 118 may be threaded on neck finish 110 to close the bottle and form a continuation of neck 108. The cap includes means engagable with the rib 116 to lock the cap on the bottle and render the filled bottle tamper proof. If desired, a similar rib may be provided on the neck finish of bottle 10 for use with a cap like 118 to render bottle 10 tamper proof.

Body 104 is generally rectangular in horizontal cross section and includes a pair of hand grip recess major walls 120 to facilitate hand holding the bottle during manipulation and pouring.

The neck and neck finish 108 and 110 are located adjacent the minor width side 124 of the body so that the shoulder 106 includes a eccentric portion 126 extending from the top body edge 128 to the bottom of neck 108.

An interior vent tube 130, similar to vent passage 34, is formed in the minor width side of shoulder portion 126 above the side 124. The vent passage 130 extends generally vertically from a wide triangular mouth 136 at edge 128 to upper mouth 138 at step 112. Mouths 136 and 138 are like mouths 46 and 38. The vent passage defines an interior vent passage 139 extending between the mouths of bottle 100 like passage 36. It includes a relatively deep portion vertical 140 at neck 108 having a cross section similar to the section of FIG. 7, a second shallower portion 142 extending between portion 140 and the lower mouth 136 and having a cross section similar to the section of FIG. 6. Portion 142 slopes inwardly from the lower mouth at a shallow angle. The interior walls of vent passage portions 140 and 142 are joined at a weld seam or pinch line 144 shown in FIG. 13 extending along the length of the vent passage. The sides of the passage diverge at mouth 136 to provide a desirable enlarged mouth. Side 132 includes a pair of wall sections 146 located to either side of the vent passage 130 similar to wall sections 60 of FIG. 3. The portions of sections 146 extending along the shoulder slope inwardly at a shallow angle and the portions of the sections extending along the neck 108 are vertical. See FIG. 11. The sections 146 form a dam 148 at the upper mouth 138. Dam 148 functions like dam 68.

The vent passage 139 has the same advantages as vent passage 36 described in connection with bottle 10. During pouring the user grips the recessed walls 120 with the vent passage on top of the bottle and then lowers the neck finish so that a steady continuous and aimable stream of laminar flow liquid pours out the neck finish while air flows inwardly through the vent passage to a growing air pocket within the bottle. The vent passage also facilitates venting a completely inverted bottle 100.

In bottle 100 the vent passage extends along the nearly vertical minor width sidewall. If desired, the vent passage could be formed in the opposite side of the bottle and extend along a longer angled path to edge 128.

Figure 14:
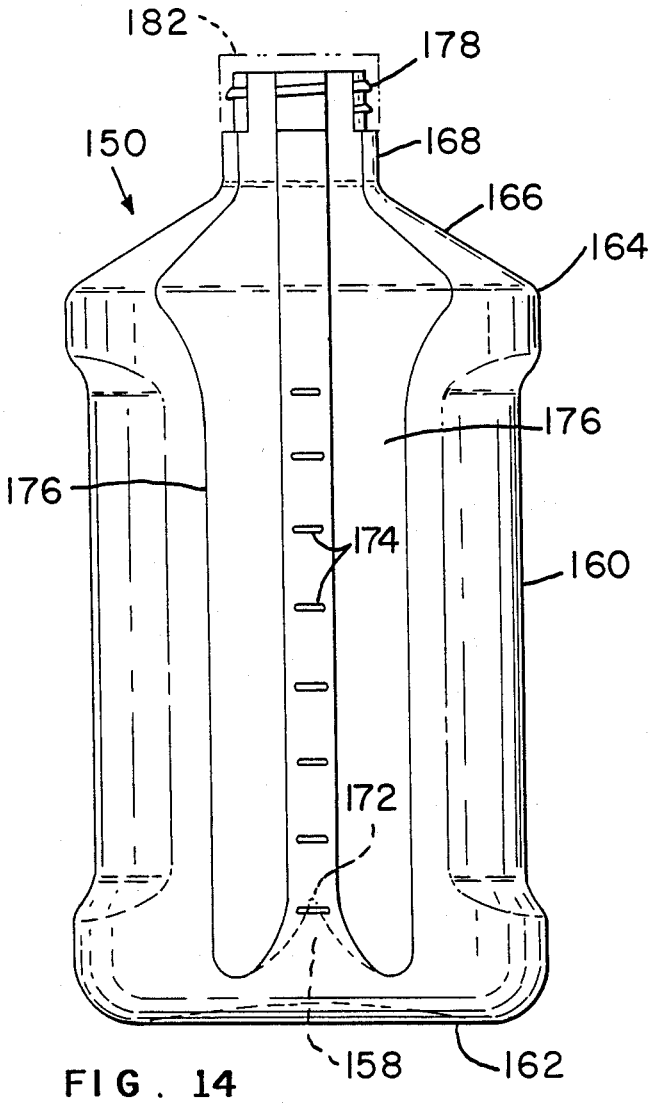
FIGS. 14, 15 and 16 are views of a third example bottle.
Figure 15:
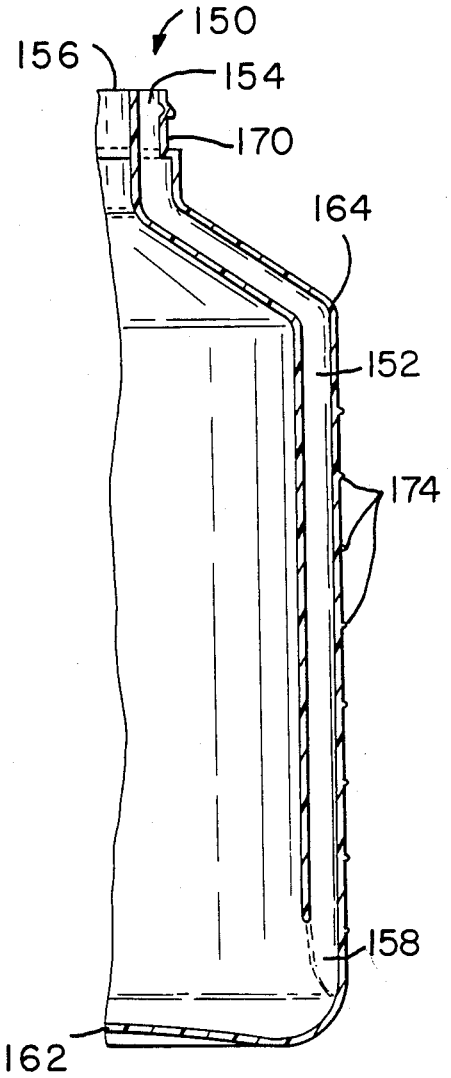
Figure 16:
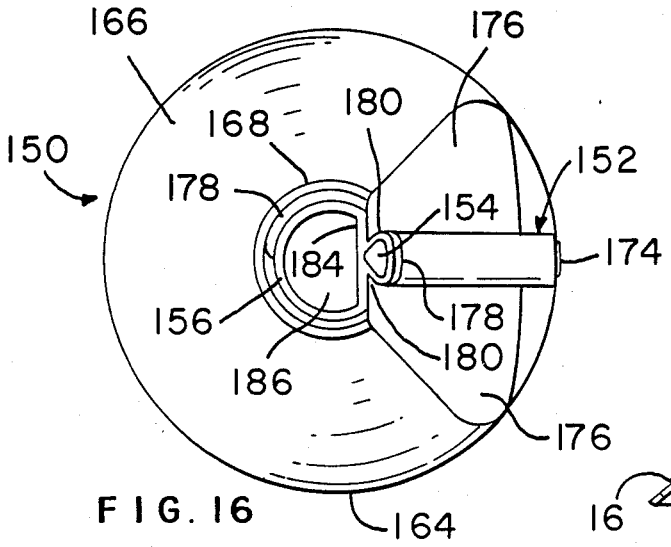

FIGS. 14, 15 and 16 illustrate a third example blow molded body held bottle 150 like bottle 10 but with an interior vent passage 152 extending between an upper mouth 154 at the bottle lip 156 and a lower mouth 158 at the bottom of body 160 above base 162. The passage 152 extends vertically along the body from mouth 158 to edge 164 at the top of body 160. The passage extends inwardly and upwardly from the edge 164 along shoulder 166 to the bottom of neck 168. The passage extends vertically along the neck to the upper mouth at lip 156. The portion of the passage extending along the shoulder and body has a cross section essentially as shown in FIG. 6. The portion extending along the neck has a cross section essentially as shown in FIG. 7. The portion extending upwardly along the neck flash 170 has a cross section approximately equal in cross section of the portion extending along the shoulder and body.

Enlarged lower mouth 158 includes an apex 172 and diverging edges to either side of the apex. The lower mouth is generally triangular in shape and has the advantages of mouths 46 and 136 as previously described in connection with bottles 10 and 100. Level indicating indicia 174 are spaced along the outer wall of the passage on body 160. Similar indicia 76 are provided on the body of bottle 10.

Wall sections 176 are formed in the body, shoulder, neck and neck flash of bottle 150 and extend from the seam or pinch line at the inside of the vent passage to the outer surface of the bottle. The wall sections are generally planer along the body, shoulder, neck and neck flash. As indicated in FIG. 16, the wall sections extend up to the lip and interrupt the spiral thread 178 on neck flash 170. The outer wall of the vent passage lies on the outer cylindrical surface of the neck flash.

The walls 176 and the angled interior walls of the upper portion of the vent passage form two angled recesses 180 extending into the cylindrical surfaces of neck 168 and neck flash 170. Cap 182 engages thread 178 and seals against the lip and the top edges of the vent passage and dam 184 to close the bottle.

Liquid is poured from a filled bottle 150 by tipping the bottle to one side with the vent passage 152 on the top of the bottle. Liquid is discharged in a rapidly flowing, controllable and laminar flow stream like the streams of liquid poured from bottles 10 and 100. The upper vent passage mouth 154 is located outside of the bottle mouth 186 and communicates directly with air outside of the bottle. In this construction, the flow of liquid discharged through mouth 186 does not close the upper mouth, despite the proximity between mouths 154 and 186.

Some body held bottles have smoothly curved bodies extending from a bottom up to a neck without a distinct shoulder. These bottles may be provided with vent passages as described. The passage extends down from the neck and along the side of the bottle to an enlarged mouth located a sufficient distance below the bottle mouth to vent the interior of the bottle during pouring.

The term "body held bottles" as used describes relatively small bottles of the type described which are held and manipulated by grasping the body of the bottle. The size and weight of the filled bottle permit the user to easily manipulate the bottle and pour liquid from the bottle while the body is held in one hand. Body held bottles are filled with a relatively small volume of liquid, about two liters or less. One quart body held bottles are frequently used for marketing engine oil.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A hand held blow molded plastic bottle with improved pour characteristics, said bottle having a continuous and handle-free outer surface generally symmetrical about an axis and including a generally cylindrical body easily gripped in a single hand for manipulation and pouring of liquid out through the mouth; a base on the bottom of the body; a shoulder on the top of the body; a generally cylindrical neck on the top of the shoulder; a generally cylindrical neck flash on the top of the neck, the neck flash having a diameter less than the diameter of the neck; a radial inward step joining the neck to the neck flash; a thread on neck flash; a dam partially closing the interior of the neck at the radial inward step, the dam and the neck defining a pouring mouth communicating with the interior of the bottle, an integral vent tube extending along the one side of the neck and shoulder and having an upper mouth opening through the dam a distance from the pouring mouth and facing outwardly of the bottle and a lower mouth opening into the interior of the body; a continuous weld seam joining the length of the vent tube to the shoulder and neck of the bottle without breaks extending through the weld seam, the vent tube having an outer wall spaced from the axis of the bottle a distance approximately equal to the distance the surface of the neck and shoulder on the opposite side of the bottle from the outer wall is spaced from the axis of the bottle, a pair of angled interior walls joined to and extending to either side of the weld seam along the length of the vent tube between the upper and lower mouths, said interior walls joining the outer wall to the weld seam at the shoulder so that the shoulder portion of the vent tube is generally triangular in transverse cross section, and a pair of opposed side walls extending along the neck, said opposed side walls joining the outer wall to the interior walls at the neck so that the neck portion of the vent tube is generally pentagonal in transverse cross section, and a pair of vee-shaped recesses each extending along one side of the weld seam between the ends of the vent tube.

2. A bottle as in claim 1 wherein the shoulder and neck include wall sections located to either side of the vent tube, and said sections extend approximately 90 degrees around the axis of the bottle.

3. A bottle as in claim 1 wherein said recesses extend to the top of the dam and the step is discontinuous at the tops of the recesses.

4. A bottle as in claim 1 wherein the cross sectional area of the neck portion of the vent tube is greater than the cross sectional area of the shoulder portion of the vent tube.

5. A bottle as in claim 4 wherein the vent tube side walls are parallel.

6. A hand held blow molded plastic bottle with improved pour characteristics, said bottle having a continuous and handle free outer surface and including a neck at the top of the bottle; a base at the bottom of the bottle; a generally tubular body joining the neck and base; a dam partially closing the interior of the neck, the dam and neck defining a pouring mouth communicating with the interior of the bottle; a vent tube extending along the neck and body, the tube having an upper mouth opening through the dam a distance from the pouring mouth and facing outwardly of the bottle and a lower mouth on the interior surface of the body below the dam; a continuous weld seam extending along the length of the vent tube between the upper and lower ends; said seam integrally joining the tube to the neck and body; a cylindrical neck flash above the neck; a lip on the top of the neck flash, said upper mouth and dam being located adjacent the lip, wall sections formed in the neck flash, neck and body to either side of the vent tube, extending between the upper and lower mouth and defining angled recesses at the weld seams; and a thread on the neck flash having discontinuous segments separated by the recesses.

7. A bottle as in claim 6 including a shoulder connecting the top of the body and the neck.

8. A bottle as in claim 7 wherein said body is generally cylindrical and coaxial with the shoulder, neck and neck flash.

9. A hand held blow molded plastic bottle with improved pour characteristics, said bottle having a continuous and handle-free surface and including a neck at the top of the bottle; a shoulder joined to the neck; a body joined to the shoulder and a base joined to the body at the bottom of the bottle, said body having a generally rectangular shape with four walls extending between the base and shoulder, said neck being located to one side of the bottle above one of said body sides, the portion of the shoulder between such body side and the neck forming an extension of such body side; a dam on the side of the neck adjacent the such portion of the shoulder and above said body side partially closing the interior of the neck, the dam and neck defining a pouring mouth communicating with the interior of the bottle away from the portion of the shoulder; a vent tube extending along the neck and the portion of the shoulder, the vent tube having an upper mouth opening through the dam a distance from the pouring mouth and facing outwardly of the bottle and a lower mouth on the interior surface of the bottle; a continuous weld seam joining the length of the vent tube to the shoulder and neck of the bottle without breaks extending through the weld seam; wall sections formed in the neck and in the portion of the shoulder located to either side of the weld seam; and shallow vee-recesses to either side of the weld seam separating the vent tube from the wall sections.

10. A bottle as in claim 9 wherein said body includes two major width sides, two minor width sides and the neck and the vent tube are located above a minor width side of the body.

11. A bottle as in claim 10 wherein the lower mouth of the vent tube is located adjacent the bottom of the shoulder.

* * * * *